US006129146A

United States Patent [19]

Krueger et al.

[11] Patent Number: 6,129,146

[45] Date of Patent: Oct. 10, 2000

[54] MANIFOLD FOR A BRAZED RADIATOR

[76] Inventors: David L. Krueger, 12352 W. Dunbar, Dundee, Mich. 48131; Michael T. Putinta, 2717 Elton Cir., Lambertville, Mich. 48144; Tom E. Rashley, 7588 Hillcrest Ct., Manitou Beach, Mich. 49253

[21] Appl. No.: 09/312,598

[22] Filed: May 17, 1999

[51] Int. Cl.[7] ..... F28F 9/02

[52] U.S. Cl. ..... 165/173; 228/183; 285/921; 285/213

[58] Field of Search ..... 165/173, 175, 165/178; 285/213, 189, 921, 192; 228/183; 29/890.052

[56] References Cited

U.S. PATENT DOCUMENTS

| | | | |
|---|---|---|---|
| 3,222,093 | 12/1965 | Simmons | 285/162 |
| 4,278,188 | 7/1981 | Stephenson et al. | 222/182 |
| 5,172,762 | 12/1992 | Shinmura et al. | 165/173 |
| 5,236,106 | 8/1993 | Laska | 222/82 |
| 5,427,263 | 6/1995 | Bowles | 220/86.2 |
| 5,501,271 | 3/1996 | Wijkstrom | 165/173 |
| 5,842,515 | 12/1998 | Kim | 165/175 |

*Primary Examiner*—Allen Flanigan
*Attorney, Agent, or Firm*—Reising, Ethington, Barnes, Kisselle, Learman & McCulloch, P.C.

[57] ABSTRACT

A heat exchanger is disclosed with one piece manifolds formed from a unitary sheet of metal. Each manifold has first and second sidewalls and a third sidewall extending therebetween the a lap joint between the side edges of the metal sheet. The first and second sidewalls are flat and the first is provided with tube apertures for receiving cooling tubes extending between a pair of manifolds. The second sidewall is flat and is provided with a socket for receiving the end of a pipe fitting in an interlocking connection. The manifold is clad on both sides with a brazing material and the manifold assembly with all attached parts are heated in a brazing oven to effect final assembly of the heat exchanger.

5 Claims, 3 Drawing Sheets

FIG-1
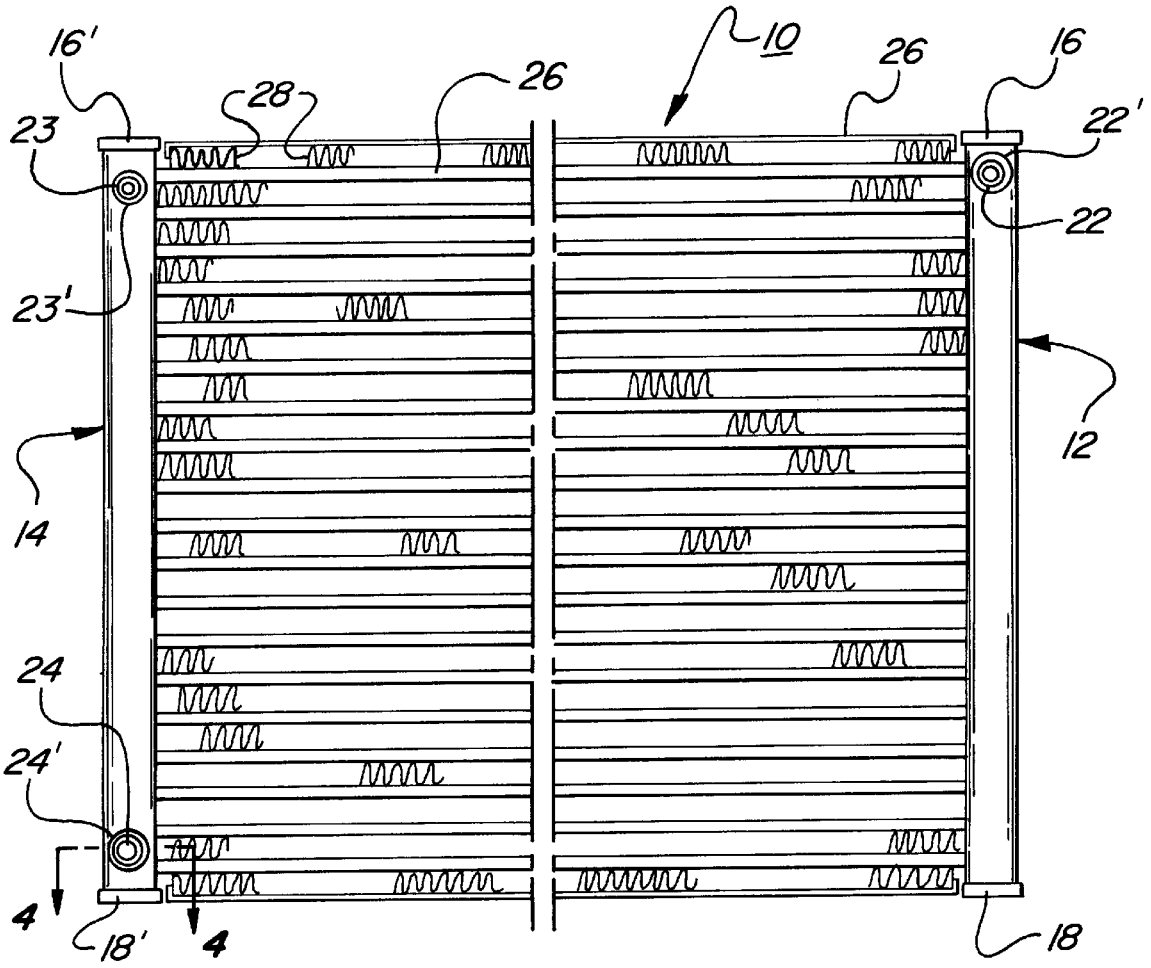
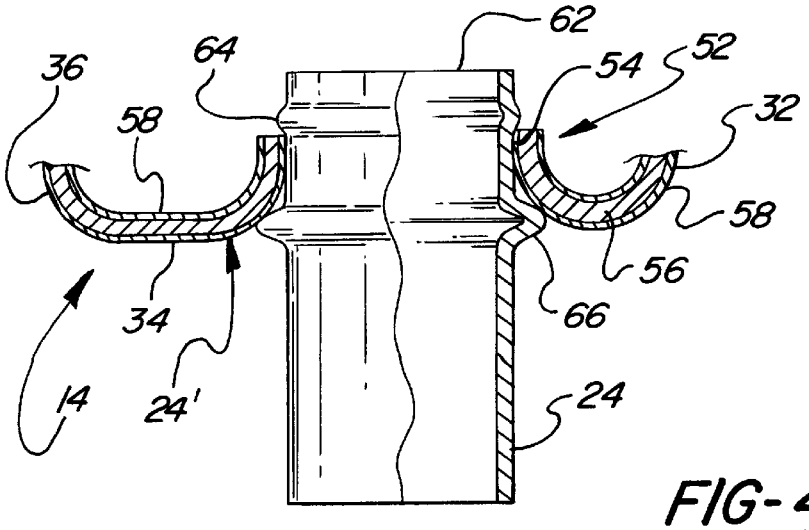
FIG-4

MANIFOLD FOR A BRAZED RADIATOR

FIELD OF THE INVENTION

This invention relates to heat exchangers and more particularly, it relates to an improved manifold for heat exchangers.

BACKGROUND OF THE INVENTION

In the automobile industry, heat exchangers, such as those used for engine cooling, are manufactured in high volume and must meet the requirements of reliability and low cost. Additionally, the heat exchanger should be adaptable in design so that it can be installed in available installation space in a particular vehicle. A typical automotive heat exchanger comprises a pair of manifolds or headers with a plurality of tubes extending between the manifolds for conveying cooling fluid between the manifolds. Heat radiating fins are secured between the tubes to promote heat transfer to the surrounding atmosphere. Inlet and outlet pipes are connected to the manifolds for circulation of the engine cooling fluid through the heat exchanger. Mounting brackets for the heat exchanger are also connected with the manifolds.

The components of the heat exchanger are typically made from aluminum. For each two components which are to form a water-tight joint, at least one of said components must be provided with a cladding of brazing material for sealing both said components together in final assembly. The manifolds are typically formed from aluminum sheet which is rolled to form a pipe with the edges joined together.

For connecting the plurality of tubes to the manifolds, a plurality of slots are provided in the manifolds and the tubes are inserted into the slots. The fins are positioned between the tubes. End caps are placed over the ends of the manifolds and the inlet and outlet pipes are positioned in openings in the manifolds. The components of the heat exchanger described above are held and properly positioned in a provisional assembly by suitable fixtures. The provisional assembly is then heated in a brazing furnace to provide a final assembly with permanent joints between all said heat exchanger components and the manifolds.

In the prior art, it is common practice to make heat exchangers with one-piece manifolds wherein each manifold is formed from sheet metal with the longitudinal edges of the sheet stock being joined together to form a pipe. This is disclosed in the Nobusue et al. U.S. Pat. No. 4,945,635 granted Aug. 7, 1990 and the Kobayashi et al. U.S. Pat. No. 5,243,842 granted Sep. 14, 1993. Both of these patents disclose the use of sheet aluminum with a cladding of brazeable material.

Other patents which disclose heat exchangers including one-piece manifolds are: Rhodes et al. U.S. Pat. No. 5,743,122, granted Apr. 28, 1998; Shinmura et al. U.S. Pat. No. 5,172,762, granted Dec. 22, 1992; Hutto et al. U.S. Pat. No. 5,481,800, granted Jan. 9, 1996; Ando U.S. Pat. No. 5,082,051, granted Jan. 21, 1992; Aoki patent U.S. Pat. No. 5,214,847 granted Jun. 1, 1993; and Kato patent U.S. Pat. No. 5,558,159 granted Sep. 24, 1996. Of these, Rhodes et al. describes a circular manifold with a brazed butt joint. The Shinmura et al. patent and the Hutto et al. patent both disclose a lap joint in a cylindrical manifold. The Shinmura et al. patent discloses a one-piece manifold of rectangular configuration with an interlock joint of the longitudinal edges.

The prior art also discloses joining of a pipe or tube into the sidewall of a larger pipe or tube with soldering or brazing of the pipes. The Kushner et al. U.S. Pat. No. 3,971,500 granted Jul. 27, 1976 discloses a heat exchanger with a small cylindrical tube joined to the wall of a larger cylindrical tube by a solder connection. The small tube is formed with an annular rib and the free end is inserted into a circular opening in the larger tube. Both tubes are provided with a cladding of solder and are heated to reflow the solder to join the tubes together. The Hingorany U.S. Pat. No. 3,750,747 granted Aug. 5, 1973 discloses attachment of a metal plate with a solder cladding to an unclad tube by heating the parts to solder them together.

Also in the prior art is a manifold for a heat exchanger as shown in FIG. 3. This manifold comprises a plastic molded tank A which has a flat rim B on the top of the walls and also has pipes C attached. A manifold panel D is formed from sheet metal as a flat panel with unitary attachment flanges E extending from all sides of the panel. A sealing gasket F is disposed between the rim of the tank and the bottom surface of the panel. After the flat tubes (not shown) are brazed to the manifold panel D, the attachment flanges E are crimped around the rim B to clamp the gasket F between the rim and panel.

SUMMARY OF THE INVENTION

In accordance with this invention, an improved heat exchanger is provided which can be manufactured at low cost, affords reliability in operation and is especially adaptable in design to meet the requirements of size, configuration and placement of fittings to meet restrictions on available installation space.

Further, in accordance with this invention, an improved manifold is provided for a heat exchanger which is of simple design and which lends itself to provisional assembly of components including the manifold tubes and the inlet and outlet pipe fittings. This is accomplished by providing the manifold with one sidewall which is flat for connection of the manifold tubes and with another sidewall which has a flat section with a socket for connection to either an inlet or outlet pipe fitting and/or auxiliary fittings.

Further, in accordance with this invention, the manifold is of unitary structure formed from a single piece of sheet aluminum which is clad with a brazing material whereby the components may be simultaneously joined to the manifold by heating of a provisional assembly thereof in a brazing oven.

Further, in accordance with this invention, a one piece manifold of sheet aluminum which is clad with a brazing material is formed with two adjacent flat walls one of which is provided with manifold apertures for a plurality of flat tubes and the other is provided with one or more special sockets. One of the said sockets is for connection to either an inlet or outlet pipe fitting. A secondary socket may be used for auxiliary fittings as may be associated with heat exchanger degassing or pressure control and with regard to a completed assembly. A third wall of any desired configuration and dimension includes a brazed joint between the two longitudinal edges of the aluminum sheet whereby the joint may be brazed simultaneously with the assembly of components to the manifold.

A complete understanding of this invention may be obtained from the detailed description that follows taken with the accompanying drawings.

DESCRIPTION OF THE DRAWINGS

FIG. 1 is an elevation view of a heat exchanger which embodies the manifold of this invention;

FIG. 4 is a view taken on lines 4—4 of FIG. 1;

BEST MODE FOR CARRYING OUT THE INVENTION

Figure 2:
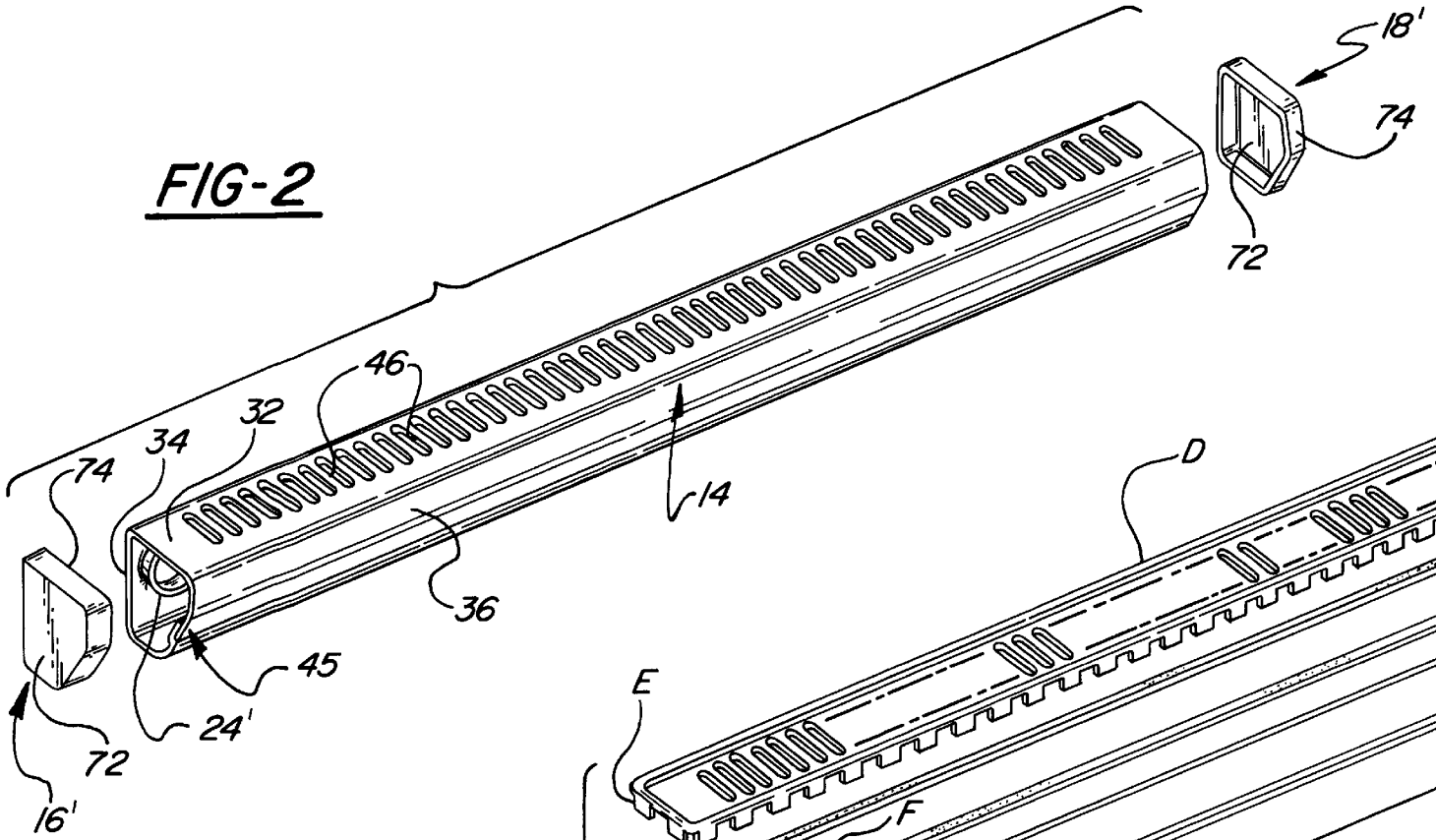
FIG. 2 is a perspective exploded view of the manifold of this invention.
Figure 3:
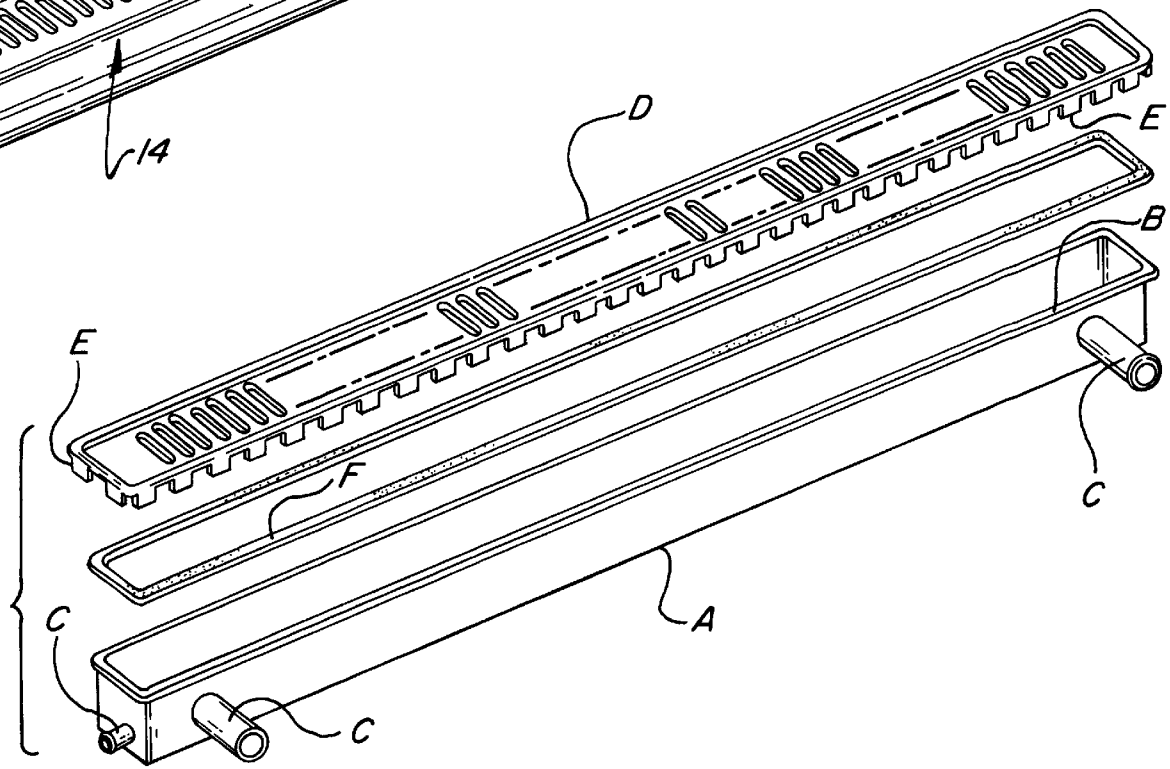
FIG. 3 shows a prior art construction of the manifold of a heat exchanger.

Referring now to the drawings, there is shown an illustrative embodiment of the invention in a manifold for a heat exchanger of the type adapted for use as a radiator in an automobile. It will be appreciated, as the description proceeds, that the invention is useful in other applications and may be realized in a wide variety of embodiments.

FIG. 1 is a rear elevation view of a heat exchanger 10 of the type which is adapted for use as an automobile radiator. It comprises, in general, a pair of manifolds 12 and 14 which are disposed parallel to each other. The manifold 12 is provided with end caps 16 and 18. The manifold 12 is also provided with a coolant inlet pipe fitting 22 which makes a fluid tight joint with a socket 22' in the manifold for introduction of liquid coolant into the heat exchanger. The manifold 14 is of the same construction as manifold 12 except that it has coolant outlet pipe fitting 24 in a fluid tight joint with a socket 24' and a smaller pipe fitting 23 in a fluid tight joint with a socket 23' for degassing or vapor pressure control connected therewith. Manifold 14 is provided with end caps 16' and 18'. It will be understood that the manifolds 12 and 14 may also differ from each other by internal baffles to control the flow path of the coolant through the heat exchanger. A plurality of flat tubes 26 extend between the manifolds 12 and 14 and are disposed parallel with each other and perpendicular to the manifolds. One end of each flat tube 26 extends through one of a plurality of slots (not shown in FIG. 1) in manifold 12 and makes a fluid tight connection with it. Likewise, the other end of said flat tube extends through an opposed slot in manifold 14 and makes a fluid tight connection with it. Heat radiating fins 28 are disposed between the tubes 26 and are connected with the tubes to provide improved heat exchange between the tubes and the atmosphere.

Figure 5:
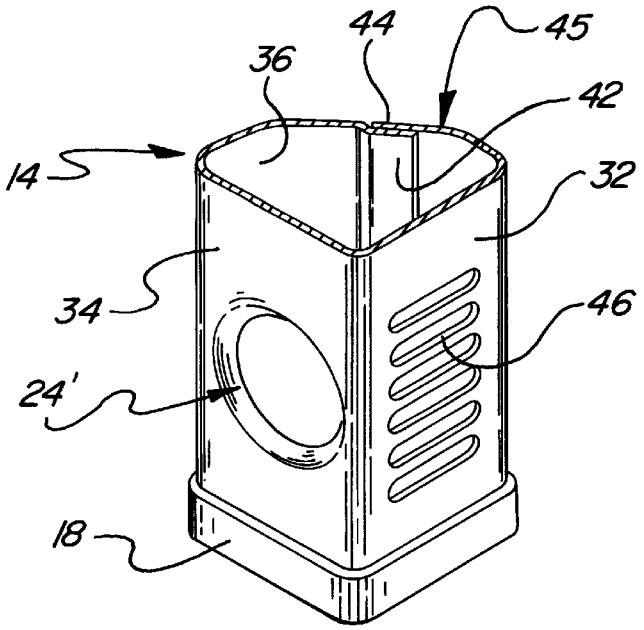
FIG. 5 is a perspective view of the lower end of the manifold of this invention.

The manifold 14 will now be described with reference to FIGS. 2 and 5. The manifold 14 is a unitary structure made from a single piece of sheet metal preferably from clad aluminum. The cladding is a brazing material for the purpose of forming brazed joints between the manifold and components connected therewith in the final assembly of the heat exchanger. The manifold is formed from flat sheet metal into a pipe-like structure having first and second adjoining flat sidewalls 32 and 34 which are connected together by a third sidewall 36. The third sidewall includes longitudinal edges 42 and 44 of the sheet metal which are formed in an overlapping relationship to make a lap joint 45. The flat sidewall 32 is provided with a plurality of transversely extending slots 46 which are disposed parallel to each other in a linear array between the two ends of the manifold. The slots 46 are suitably punched in the sheet metal either before or after it is shaped to form the three walls. The second flat sidewall 34 is provided with a socket 24' for receiving an inlet or outlet supply pipe fitting 24.

The connection of the pipe fitting 24 with the manifold 14 will be described with reference to FIGS. 4, 5 and 6. As shown in FIG. 4, the pipe socket 24' is formed in the sidewall 34 as a circular opening defined by an annular flange 52 which is unitary with the sidewall 34 and extends inwardly thereof and terminates in a free end 54 inside the manifold. The annular flange 52 is of circular cross-section with a diameter which progressively decreases over a distance extending at least partly from the flat wall 34 to the free end. As shown in FIG. 4, the sheet metal of the manifold 14 includes a core material 56 of aluminum with a cladding 58 of brazing material on both sides. The pipe fitting 24 is made of unclad aluminum. The end of the pipe fitting 24 is formed to provide an interlock connection with the socket 24' in the sidewall 34. The pipe fitting 24 is circular in cross-section and terminates in a free end 62 which, in final assembly, is disposed within the manifold. The pipe fitting is provided with first and second axially spaced annular ribs 64 and 66 disposed on the outside surface adjacent the free end. The annular rib 64 is of smaller diameter and is disposed closer to the free end than the rib 66. The axial spacing of the ribs is approximately the same as the length of the annular flange 52. The diameter of the pipe at the free end is such that it can be inserted into the flange 52 with a force-fit until the annular rib 66 abuts the annular flange adjacent the flat portion of the sidewall 34. In this position, the rib 64 is disposed inwardly of the free end of the annular flange. In this relationship, the pipe is held captive by the annular flanges in a position for brazing the pipe to the flange.

Figure 6:
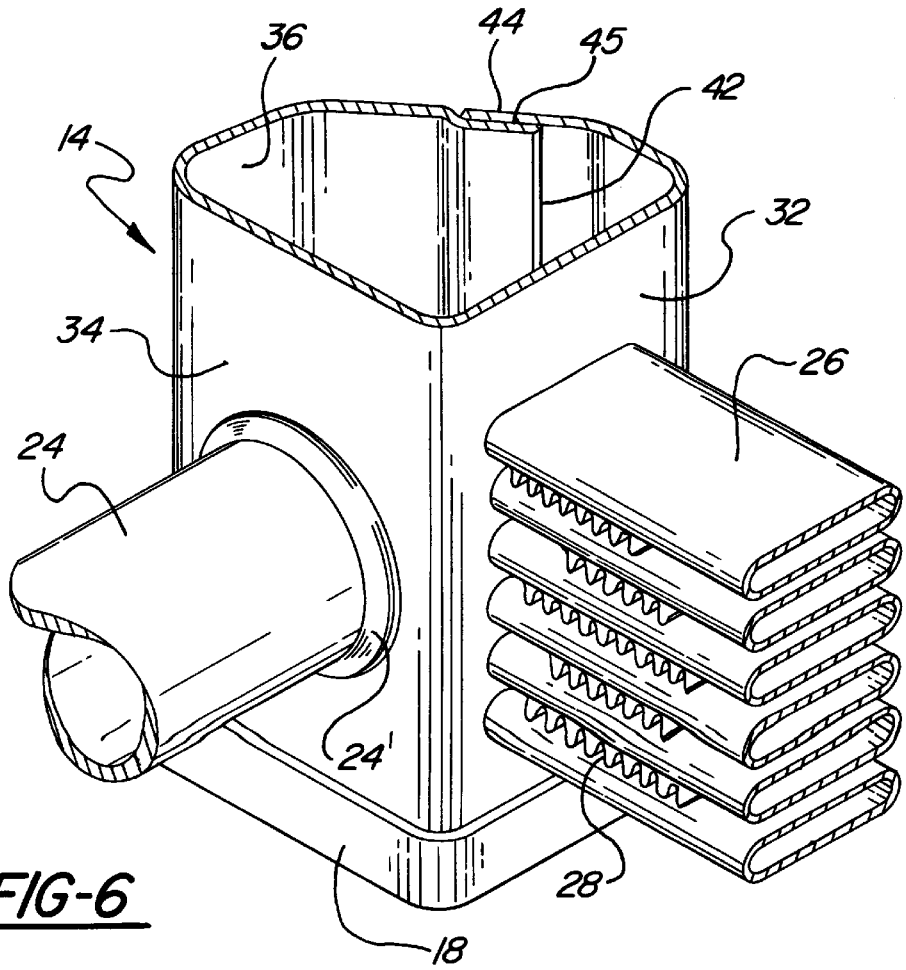
FIG. 6 is a perspective view of the lower end of the manifold of this invention with the manifold tubes and a coolant pipe fitting connected with the manifold.

The connection of the manifold tubes 26 to the manifold 12 is shown in FIG. 6. Since the sidewall 32 of the manifold is flat, the manifold slots 46 are of the same configuration as the cross-sectional periphery of the manifold tubes 26 and afford a sufficient clearance to allow insertion of the tubes without interference. The tubes are preferably constructed of aluminum with a cladding of brazing material on the exterior surface. The tubes are inserted into the slots just slightly beyond the inner surface of the sidewall 32 and held in position by suitable fixturing for brazing the tubes to the manifold.

As shown in FIG. 2, the end caps 16' and 18' for the manifold 14 include an end plate 72 and a peripheral flange 74 with the same cross-sectional configuration as the manifold 14. The end caps are suitably made of aluminum with or without cladding and provide a fluid tight connection with the manifold after the joints are brazed.

It will now be appreciated that a one-piece manifold is provided which is readily adapted for use in fabricating a brazed radiator. For this purpose, the manifold is preferably formed of sheet aluminum which is clad on both sides with brazing material. In a preliminary stage, a heat exchanger is fabricated by provisional assembly of a pair of headers 12 and 14 with the manifold tubes 26 and fins 28 disposed therebetween and with the pipe fittings 22, 23 and 24 inserted into the sockets 22', 23' and 24' of the manifolds. This provisional assembly may be supported by suitable fixtures for heating in a brazing oven to effect the final assembly of the heat exchanger.

Although the description of this invention has been given with reference to a particular embodiment, it is not to be construed in a limiting sense. For a definition of the invention, reference is made to the appended claims.

What is claimed is:

1. In a heat exchanger of the type comprising a pair of manifolds with a plurality of tubes extending between the manifolds and providing fluid communication therebetween, an inlet pipe fitting connected with one manifold and an outlet pipe fitting connected with one manifold, the improvement comprising:

at least one of said manifolds being formed from a unitary sheet of sheet metal having a pair of side-edges and having a cross-section with first and second sidewalls adjoining each other and a third sidewall connecting said first and second sidewalls together, said third sidewall including a lap joint between said side-edges, said first sidewall being flat and provided with a plurality of tube apertures disposed in a row along the length of said one manifold, said tube apertures having the same configuration as the cross-sectional configuration of said tubes whereby each tube can be inserted in a tube aperture, said second sidewall having at least a portion thereof which is flat, the flat portion being provided with a pipe fitting opening for receiving one of said pipe fittings, said pipe fitting opening having the same configuration as the cross-sectional configuration of said one of said pipe fittings whereby said one of said pipe fittings can be inserted into said pipe fitting opening.

2. A heat exchanger as defined in claim 1 including:

an end cap disposed on each end of said one manifold, each said end cap comprising an end plate and a unitary flange in engagement with the peripheral surface of said manifold pipe, each said end cap being formed of sheet metal.

3. A heat exchanger as defined in claim 1 wherein:

said sheet metal is clad with brazing material for brazing said lap joint, for brazing said one of said pipe fittings to said second sidewall, and for brazing said flat tubes to said first sidewall.

4. A heat exchanger as defined in claim 1 wherein:

said opening being defined by an inwardly extending annular flange having a circular cross-section, said annular flange being unitary with said second sidewall and terminating in a free end and being of progressively smaller diameter over a distance extending at least partly from said flat portion to said free end, said one of said pipe fittings being circular in cross-section and terminating in a free end and having first and second axially spaced annular ribs disposed on the outside thereof adjacent said free end, said first annular rib being of smaller diameter and disposed closer to said free end than said second annular rib, the axial spacing of said annular ribs being approximately the same as the length of said annular flange, the diameter of said free end of said one of said pipe fittings being such that it can be inserted into said flange with a force-fit to a position in which said second annular rib abuts said annular flange adjacent said flat portion of said first sidewall and with said first annular rib disposed inwardly of the free end of said annular flange, whereby, after insertion of said free end of said one pipe fitting into said annular flange said pipe is held in said position by said annular flange for brazing said one pipe to said flange.

5. For use in a heat exchanger, a manifold formed of sheet metal into a pipe-like structure with a wall having a flat portion thereon, said a flat portion being provided with an opening surrounded by an inwardly extending annular flange having a circular cross-section, said annular flange being unitary with said wall and terminating in a free end and being of progressively smaller diameter over a distance extending at least partly diameter from said flat portion to said free end, a pipe fitting having a circular cross-section and terminating in a free end, said pipe having first and second axially spaced annular ribs disposed on the outside thereof, said first annular rib being of smaller diameter and disposed closer to the free end of said pipe fitting than said second annular rib, the axial spacing of said annular ribs being approximately the same as the length of said annular flange, the diameter of said free end of said pipe fitting being such that it can be inserted into said flange with a force-fit to a position in which said second annular rib abuts said annular flange adjacent said flat portion of said wall and with said first annular rib disposed inwardly of the free end of said annular flange, whereby, after insertion of said free end of said pipe fitting into said annular flange, said pipe fitting is held in said position by said annular flange for brazing said pipe to said flange.

* * * * *